United States Patent [19]

Cochran

[11] 4,362,431

[45] Dec. 7, 1982

[54] VIBRATING APPARATUS FOR VIBRATORY COMPACTORS

[75] Inventor: Thomas E. Cochran, Yorkville, Ill.

[73] Assignee: Caterpillar Tractor Co., Peoria, Ill.

[21] Appl. No.: 263,640

[22] Filed: May 14, 1981

[51] Int. Cl.[3] ..... E01C 19/38

[52] U.S. Cl. ..... 404/117; 74/61; 74/87; 366/108

[58] Field of Search ..... 404/117, 113, 114; 74/87, 61; 366/108, 116

[56] References Cited

U.S. PATENT DOCUMENTS

| | | | |
|---|---|---|---|
| 2,286,770 | 6/1942 | Symons | 74/61 X |
| 2,728,277 | 12/1955 | McRae | 404/117 |
| 2,728,614 | 12/1955 | Rink | 74/61 X |
| 2,921,477 | 1/1960 | Hanggi | 74/61 |
| 2,989,869 | 6/1961 | Hanggi | 404/113 X |
| 3,017,810 | 1/1962 | Jacklin | 404/114 |
| 3,026,781 | 3/1962 | Schafer | 404/117 |
| 3,059,483 | 10/1962 | Clynch et al. | 74/61 |
| 3,145,631 | 8/1964 | Green | 404/117 |
| 3,498,601 | 3/1970 | Koval | 271/89 |
| 3,737,244 | 6/1973 | Wilson | 404/117 |
| 3,948,329 | 4/1976 | Cummings | 173/49 |
| 4,033,193 | 7/1977 | Brandner | 74/61 |
| 4,105,356 | 8/1978 | Loveless | 404/117 |
| 4,111,061 | 9/1978 | Thomas | 74/61 |

*Primary Examiner*—Nile C. Byers, Jr.
*Attorney, Agent, or Firm*—Joseph W. Keen

[57] ABSTRACT

A shaft arrangement (34) having a transversely displaceable weight member (42) relative to the shaft arrangement's longitudinal axis (B). The shaft arrangement (34) includes a housing structure (36) within compression structure (44) is arranged. The compression structure (44) extends through the housing structure (36) and connects to the displaceable weight member (42). An elastomeric member (50) is captured between the compression structure (44) and the housing structure (36) so as to resist transverse displacement of the weight member and the connected compression structure (44). The elastomeric member (50) maintains the weight member (42) and connected compression structure (44) in a rotatably balanced position relative to the longitudinal axis (B) for rotation speeds less than a predetermined amount. When the shaft arrangement (34) is rotated faster than such predetermined speed, the weight member (42) and connected compression structure (44) are transversely displaced so as to induce vibration in the shaft arrangement (34).

17 Claims, 3 Drawing Figures

VIBRATING APPARATUS FOR VIBRATORY COMPACTORS

DESCRIPTION

TECHNICAL FIELD

This invention relates generally to vibratory compactors and, more particularly, to an apparatus for inducing selected vibration thereof.

BACKGROUND ART

Vibratory compactors are commonly employed for compacting freshly-layed asphalt paving, soils, and similar materials. The compactor comprises a drum resiliently and rotatably mounted in a frame assembly wherein an eccentric mounting shaft arrangement is located and rotates relative to the drum. An exemplary vibratory compactor is illustrated in a commonly assigned copending application Ser. No. 308,748 which was filed Dec. 3, 1980. Such shaft arrangement selectively vibrates the drum to provide the desired compaction of the material being worked.

Apparatus for inducing vibration in such shaft arrangements has heretofore included the use of multiple weight members which are sequentially or concurrently radially displaced relative to the shaft arrangement so as to obtain the desired vibrating effect on the drum. Controlling the sequence of displacement of the multiple weights has been complex and, in addition manufacture and service of such weights has been relatively difficult. Multiple weights which were sequentially activated provided the means for vibrating the drum only for shaft rotation speeds above a predetermined minimum.

The present invention is directed toward providing a simple vibrating inducement apparatus as well as meeting the criteria of providing vibratory energy for rotation speeds greater than such predetermined minimum.

DISCLOSURE OF THE INVENTION

In one aspect of the present invention a vibratory inducement apparatus includes a shaft arrangement having a longitudinal axis and a housing, a weight member transversely offset relative to the shaft arrangement's longitudinal axis, a compression structure having a portion thereof which is arranged within the housing and is connected to the weight member, and an apparatus for biasing the weight member toward the shaft arrangement's longitudinal axis. The biasing apparatus preferably constitutes a deformable elastomeric material which is disposable between and engageable with the housing and the compression structure. The compression structure is piloted in a circular bore formed in the housing on a side of the biasing means opposite from the weight member.

BRIEF DESCRIPTION OF THE DRAWINGS

The invention will be more fully understood from the following detailed description of the preferred embodiment, taken in connection with the accompanying drawings, in which.

BEST MODE FOR CARRYING OUT THE INVENTION

Figure 1:
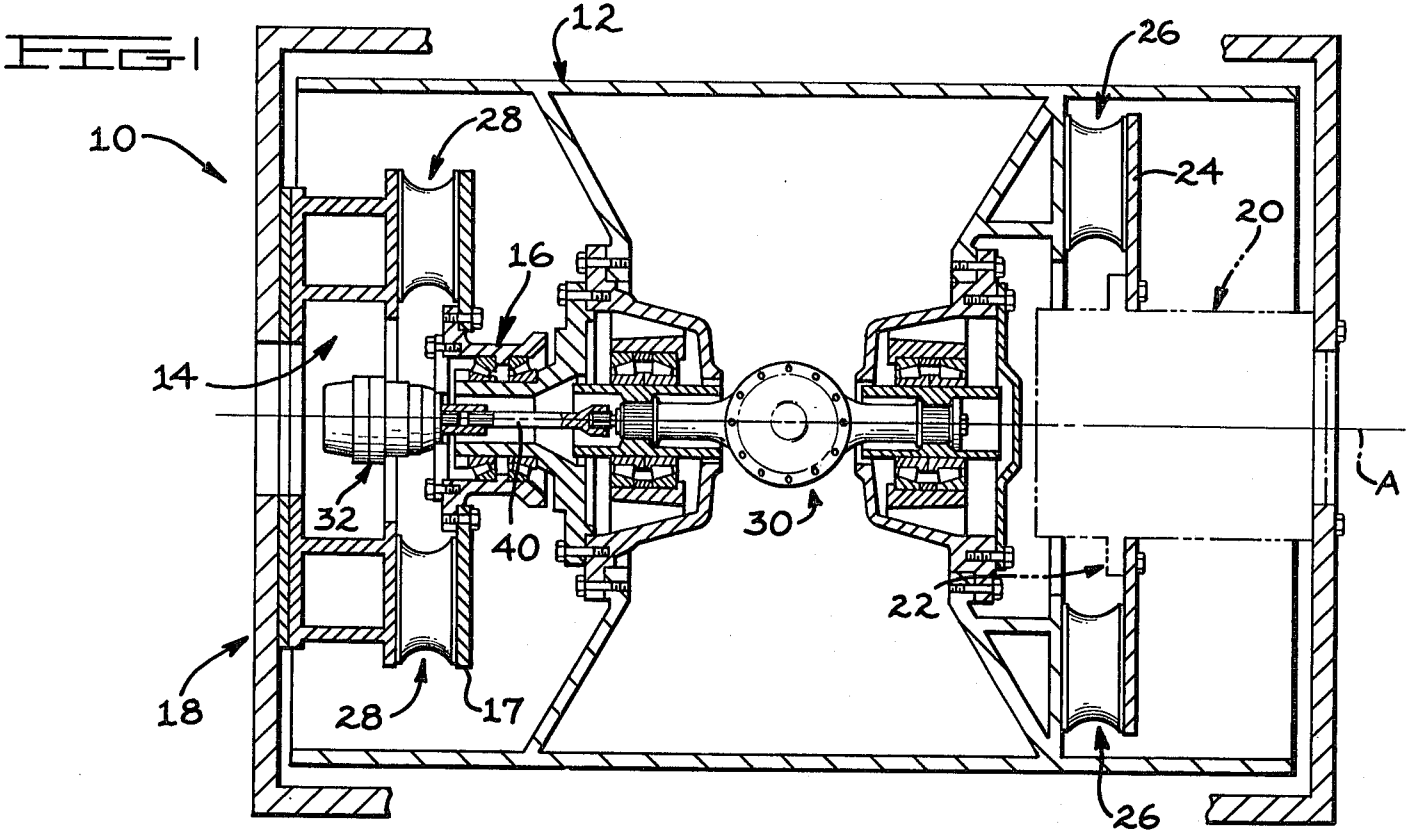
FIG. 1 is a partial transverse sectional view of a vibratory compactor drum and associated vibration inducement apparatus and vibration transmitting arrangement.

FIG. 1 illustrates a portion of a vibratory compactor 10 comprising a drum 12 which is rotatable about a longitudinal axis A thereof. One end of the drum 12 is rotatably mounted on a mounting bracket assembly 14 by a pair of tapered roller bearing assemblies 16 and an annular support plate 17. The mounting bracket assembly 14 is, in turn, secured to a frame structure 18 of the utilizing vibratory compactor 10. The opposite end of the drum 12 is connected to an electric or hydraulic drive motor 20 having a drive flange 22 suitably secured to the drum 12 through an annular plate 24 and a plurality of circumferentially spaced cushioning pads 26. Similar cushioning pads 28 preferably connect the mounting bracket assembly 14 and the support plate 17 to substantially isolate the vibratory motion of the drum 12 from the drive motor 20 and frame structure 18.

Although FIG. 1 illustrates the selective driving of the drum 12 by the driving motor 20, it is to be understood that the drum 12 could be non-driven so as to eliminate the need for the drive motor 20 and the associated structures which would be replaced by supporting structures similar to the mounting bracket assembly 14 and bearing assemblies 16 for rotational support of the drum 12 on the frame structure 18. However, in either case, a vibration inducement apparatus 30 is rotatably mounted in the drum 12 and is selectively driven by an electric or hydraulic vibration motor 32. The vibration inducement apparatus 30, when appropriately driven by the vibration motor 32, generates vibrations which are transmitted to the outer surfaces of the drum 12 for enhancing its material compaction characteristics.

Figure 2:
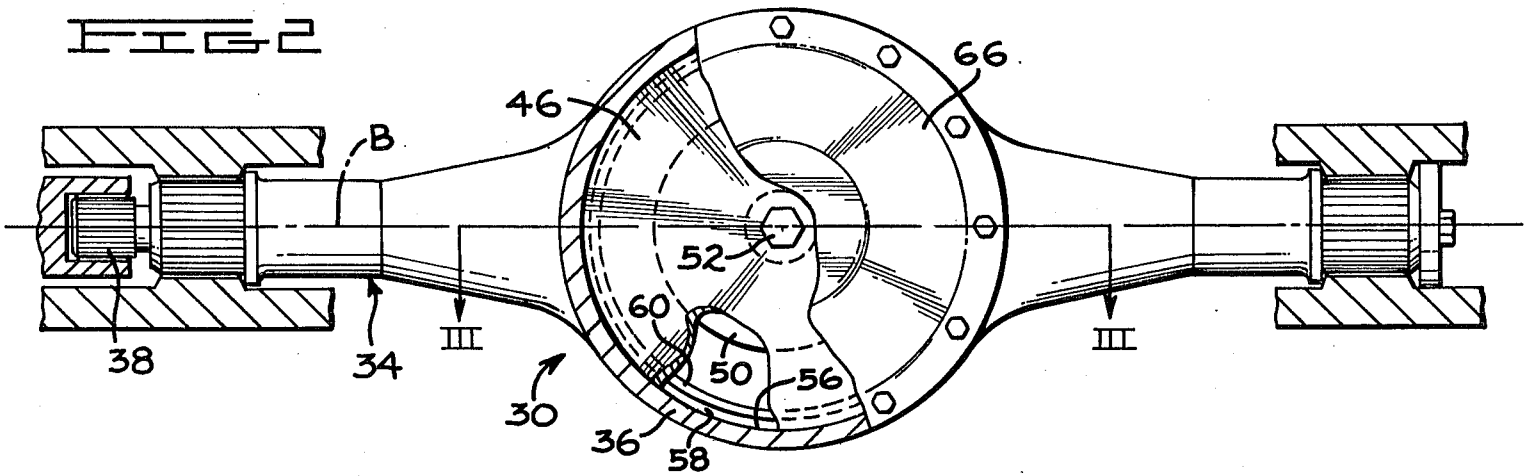
FIG. 2 is an enlarged front elevational view of the vibration inducement apparatus illustrated in FIG. 1.

The vibration inducement apparatus 30 is better illustrated in FIG. 2 and may be seen to include a shaft arrangement 34 and a housing structure 36. The shaft arrangement 34 includes a shaft 38 having external splines which are engageable by internal splines formed on the end of a drive shaft 40 extending from the vibration motor 32 to the shaft 38. The shaft arrangement 34 has a longitudinal axis B about which it is rotatable.

Figure 3:
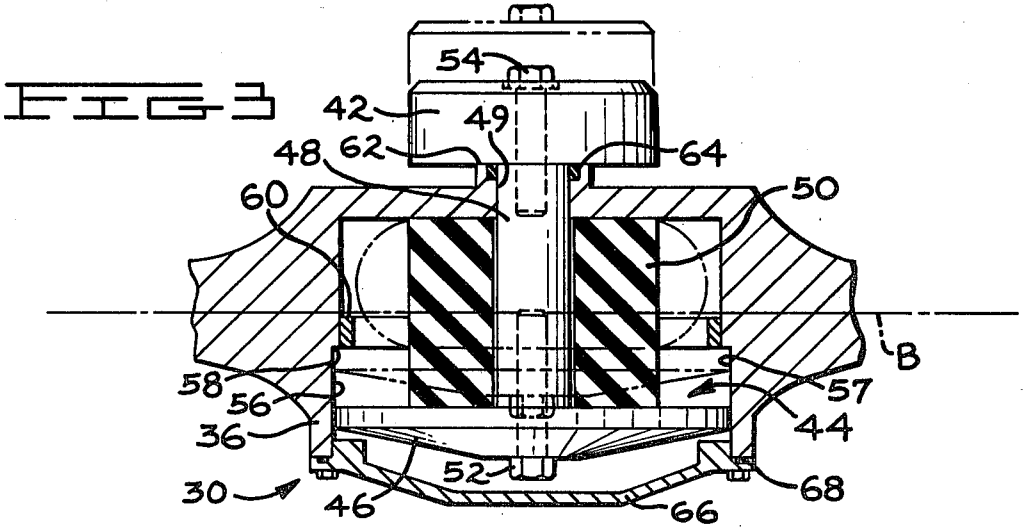
FIG. 3 is a plan sectional view of the apparatus illustrated in FIG. 2.

The vibration inducing apparatus 30, better illustrated in FIG. 3, also includes a weight member 42 having a center of gravity which is transversely offset relative to the longitudinal axis B. Hereafter, reference to the center of gravity of the weight member 42 will be accomplished by referring only to the weight member 42. A compression structure 44 has an engagement member 46 and an elongated cylindrical connection member 48 which is disposed between and connected to the weight member 42 and the engagement member 46. A guide surface 49 formed on the housing structure 36 is arranged in closely spaced encompassing relation with the connection member 48 to guide the same during displacement thereof in a transverse direction perpendicular to the longitudinal axis B. The engagement member 46 is disposed within the housing structure 36. A biasing means 50 such as the illustrated rubber biscuit 50 is disposed in the housing 36 between one wall of the housing 36 and the engagement member 46 and is centered about the longitudinal axis B when the vibration inducement apparatus 30 is in the balanced configuration illustrated in solid lines in FIG. 3. A bolt 52 is disposed through the engagement member 46 and into threaded engagement with the connection member 48 while a bolt 54 extends through the weight member 42 and is likewise in threaded engagement with the connection member 48. The bolts 52,54 interlock the elements of the compression structure 44 and the weight 42 into a single structure.

Vibratory force generated by the apparatus 30 is a function of the eccentricity of the apparatus 30 with respect to the longitudinal axis B. Centrifugal force and the counteracting biasing force resulting from compression of the rubber biscuit 50 affect the aforementioned eccentricity. For ease of operation a linear relationship between rotational speed and vibratory force (and thus eccentricity) is provided for rotational speeds greater than a predetermined minimum. Since centrifugal force increases non-linearly as the square of the rotational speed, the rubber biscuit 50 is selected to also have a compensating, non-linear biasing force-compression displacement relationship which provides the aforementioned desired linear relationship between the rotational speed and the vibratory force (eccentricity).

A counterbore 56 is formed on the interior of the housing 36 so as to receive therein in closely spaced relationship the engagement member 46. The counterbore 56 includes a guiding wall 57 and a terminating, engagement face 58 for limiting the transverse displacement of the engagement member 46. A ring 60 is welded or otherwise securely affixed to the housing 36 immediately adjacent the engagement face 58 to provide additional bearing surface to augment the engagement face's area. It is to be understood, however, that sufficient bearing area could be provided by increasing the counterbore 56 and thus the area of the engagement face 58.

An engagement surface 62 disposed on the housing 36 acts as a stopping surface for the weight member 42 against further displacement in the transverse direction toward the longitudinal axis B. While such transverse direction is preferably along a radial line relative to axis B, it is to be understood that any transverse direction perpendicular to the axis B enables satisfactory operation of the present invention.

A seal member 64 is illustrated in FIG. 3 disposed in a recess in the housing 36 and in rubbing contact with the connection member 48. Also illustrated in FIG. 3 is a housing cover 66 which may be secured to the housing 36 by bolts or other suitable means. Another seal member 68 is disposed between the housing cover 66 and the housing 36. Previously described elements 64,66,68 are primarily necessary for the case where the vibrator drum 12 is to receive ballast for further enhancing its compaction capabilities and it is desired to seal such ballast out of the interior of the housing 36.

Industrial Applicability

During operation of the compactor 10, the vibration motor 32 will be selectively driven to rotate the vibration inducing apparatus 30 and impart vibratory energy to the drum 12. The positioning of the elements illustrated in solid lines in FIG. 3 constitute a balanced configuration relative to the longitudinal axis B and thus provide a non-vibrating mode of operation for the shaft arrangement 34. By judiciously choosing the size, shape and modulus of elasticity for the biasing means 50 and the size and shape of the elements comprising the compression structure 44, vibration of the shaft arrangement 34 and thus the drum 12 is prevented for shaft rotation speeds less than a predetermined minimum. Such minimum speed for the illustrated vibration apparatus 30 is 1800 rpm, but that may be varied as a function of the compactable material, the weight of the drum 12, the weight of the weight member 42, and the weight of the compression structure 44.

When the rotation speed of the shaft arrangement 34 exceeds the predetermined minimum speed, the weight member 42 and connected compression structure 44 displace transversely relative to the longitudinal axis B in a direction tending to increase the separation distance between the weight member 42 and the longitudinal axis B. The transverse displacement ends when the centrifugal force thereon equals the opposing force induced by compression of the rubber biscuit 50. By selecting the appropriate non-linear rate of opposing biasing force versus biscuit compression, a linear relationship between the rotational speed and vibratory force is provided. For example, doubling the rotational speed when it is greater than the predetermined minimum (e.g. from 1900 to 2000 rpm) causes the vibratory force to be doubled (from 4000 to 8000 pounds). During such transverse displacement of the weight member 42 and connected compression structure 44, the guide surfaces 49 and 57 effectively pilot the compression structure 44 on opposite ends of the housing structure 36. Such piloting maintains alignment and provides reliable performance by preventing binding within the housing structure 36. Increasing rotation speeds of the shaft arrangement 34 cause increasing transverse displacements in the aforementioned direction of the weight member 42 and compression structure 44 as well as increasing the compression and resisting force of the rubber biscuit 50.

At a predetermined rotational speed corresponding to the maximum desired vibration amplitude, the compression structure 44 via the engagement member 46 engages the engagement face 58 and engagement ring 60 to effectively preclude further transverse displacement of the weight 42 and compression structure 44. Such maximum desired vibration amplitude obtains when the eccentricity of the shaft arrangement 34 is a maximum as indicated by the transverse offset of the weight member 42 illustrated in phantom in FIG. 3. Thus, by controlling the speed of the vibration motor 32, the transverse displacement of the weight member 42 and connected compression structure 44 provides the desired degree of eccentricity and vibration of the shaft arrangement 34. While the seals 64 and 68, as well as the housing cover 66, have been illustrated, it is to be understood that such elements are only necessary when it is desired to seal the interior of the housing 36 from the interior of the drum 12.

It should now be apparent that a vibratory apparatus 30 having an operationally desireable linear relationship between vibratory force and rotational speed, a durable construction, and a minimum number of moving parts has been provided. A substantial contributing factor to the durable construction is the piloting guide wall 57 in that it prevents cocking and binding of the compression structure 44 within the housing structure 36. By disposing the guide wall 57 on the opposite side of the rubber biscuit 50 from the guide surface 49, alignment of the weight member 42 and connected compression structure 44 is maintained relative to the housing structure 36. Moreover, maximizing the distance between the guide surfaces 49 and 57 in the housing structure 36 also contributes to stabilizing the alignment and providing reliable operation.

I claim:

1. An apparatus (30) for inducing vibration, said apparatus (30) comprising:

a shaft arrangement (34) which is rotatable about a longitudinal axis (B), said shaft arrangement (34) including a housing structure (36) having a guiding wall (57) and a guide surface (49);

a weight member (42) transversely offset relative to said longitudinal axis (B) and displaceable along a path perpendicular to said longitudinal axis (B);

a compression structure (44) having an engagement member (46) disposed in said housing structure (36) and a connection member (48) joining said engagement member (46) and said weight member (42), said engagement member (46) and said connection member (48) being in closely spaced, guided relation with said guiding wall (57) and said guide surface (49) respectively; and means (50) for biasing said weight member (42) and compression structure (44) in a direction tending to reduce the offset of the weight member (42) and displace said weight member (42) and compression structure (44) toward a rotatably balanced position relative to said longitudinal axis (B).

2. The apparatus (30) of claim 1, said biasing means (50) being compressible between said engagement member (46) and said housing structure (36) to bias said weight member (42) and compression structure (44) to a rotatably balanced position relative to said longitudinal axis (B), said biasing means (50) being centered on said longitudinal axis (B) when said rotatably balanced position obtains.

3. The apparatus (30) of claim 2, said biasing means (50) comprising an elastomeric member having a biasing force which is a non-linear function of said elastomeric member's compression.

4. The apparatus (30) of claim 1, wherein said weight member (42) is engageable with said housing structure (36) when said weight member (42) occupies a rotatably balanced position.

5. The apparatus (30) of claim 1 wherein said connection member (48) extends between said weight member (42) and said engagement member (46) through said biasing means (50).

6. The apparatus (30) of claim 1 wherein said housing structure (36) has a counterbore (56) formed therein, said counterbore (56) having a terminating, engagement face (58) for abutting said engagement member (46) and preventing displacement of said engagement member (46) therebeyond.

7. The apparatus (30) of claim 6 further comprising an engagement ring (60) disposed adjacent said engagement face (58) and secured to said housing structure (36) for augmenting the engagement bearing area between said housing structure (36) and said engagement member (46).

8. An apparatus (30) for inducing vibration, said apparatus (30) comprising:

a shaft arrangement (34) which is rotatable about a longitudinal axis (B), said shaft arrangement (34) having a housing structure (36) including a guiding wall (57) and a guide surface (49) separated therefrom;

a weight member (42) radially displaceable relative to said longitudinal axis (B) between a rotatably balanced position and a maximum rotatably unbalanced position;

a compression structure (44) disposed in said housing structure (36), said compression structure (44) being joined to said weight member (42), so as to move therewith, said compression structure (44) being guided by said guiding wall (57) and said guide surface (49); and means (50) disposed between said compression structure (44) and said housing structure (36) for biasing said weight member (42) and compression structure (44) towards said rotatably balanced position, said biasing means (50) being centered on said longitudinal axis (B) when said weight member (42) occupies said rotatably balanced position.

9. The apparatus (30) of claim 8, wherein said biasing means (50) comprises:

a deformable, elastomeric member (50) having a biasing force which is a non-linear function of said elastomeric member's compression.

10. The apparatus (30) of claim 8, said compression structure (44) comprising:

an engagement member (46) and a connection member (48), said engagement member (46) being engageable with said biasing means (50) and said connection member (48) joining said engagement member (46) and said weight member (42).

11. The apparatus (30) of claim 10, wherein said weight member (42) is engageable with said housing (36) when said weight member (42) occupies said rotatably balanced position.

12. The apparatus (30) of claim 8 further comprising:

means (64) for sealing between said compression structure (44) and said housing structure (36).

13. The apparatus (30) of claim 12 further comprising:

means (66,68) for fluidly sealing said housing structure (36).

14. The apparatus (30) of claim 10 wherein said connection member (48) extends between said weight member (42) and said engagement member (46) through said biasing means (50).

15. The apparatus (30) of claim 10 wherein said housing structure (36) has a counterbore (56) formed therein, said counterbore (56) having a terminating, engagement face (58) for abutting said engagement member (46) and preventing displacement of said engagement member (46) therebeyond.

16. The apparatus (30) of claim 15 wherein said guide surface (49) and said guide wall (57) are disposed on opposite sides of said biasing means (50).

17. A vibratory compactor (10) comprising:

a drum (12) which is rotatable about an axis (A);

a shaft arrangement (34) which is rotatable about a longitudinal axis (B), said shaft arrangement (34) including a housing structure (36), having a guiding wall (57) and a guide surface (49);

a weight member (42) transversely offset relative to said longitudinal axis (B) and displaceable along a path perpendicular to said longitudinal axis (B);

a compression structure (44) having an engagement member (46) disposed in said housing (36) and a connection member (48) joining said engagement member (46) and said weight member (42), said engagement member (46) being piloted by said guiding wall (57) and said connection member (48) being piloted by said guide surface (49);

means (50) for biasing said weight member (42) and compression structure (44) in a direction tending to reduce the offset of the weight member (42) and displace said weight member (42) and compression structure (44) toward a rotatably balanced position relative to said longitudinal axis (B);

means (14,16,17,24,28) for rotatably supporting said shaft arrangement (34) in said drum (12); and means (32,40) for rotating said shaft arrangement (34) at a selected speed about said longitudinal axis (B).

* * * * *